United States Patent [19]

Stork

[11] 4,296,279

[45] Oct. 20, 1981

[54] SPEECH SYNTHESIZER

[75] Inventor: John E. Stork, Malibu, Calif.

[73] Assignee: Speech Technology Corporation, Santa Monica, Calif.

[21] Appl. No.: 117,075

[22] Filed: Jan. 31, 1980

[51] Int. Cl.[3] ..... G10L 1/00

[52] U.S. Cl. ..... 179/1 SM

[58] Field of Search ..... 179/1 SM, 1 SA, 1 D, 179/15.55 R, 15.55 T; 364/724; 333/166

[56] References Cited

U.S. PATENT DOCUMENTS

| | | | |
|---|---|---|---|
| 3,641,496 | 2/1972 | Slavin | 179/1 SM |
| 3,892,919 | 7/1975 | Ichikawa | 179/1 SM |
| 4,125,898 | 11/1978 | De Hart et al. | 179/1 SM |

FOREIGN PATENT DOCUMENTS

| | | | |
|---|---|---|---|
| 1057855 | 3/1979 | Canada | 179/1 SM |

OTHER PUBLICATIONS

L. Rabiner, et al., "A Hardware Realization of a Digital Synthesizer", IEEE Trans. Comm., Dec. 1971, pp. 1016–1020.

*Primary Examiner*—Mark E. Nusbaum
*Assistant Examiner*—E. S. Kemeny
*Attorney, Agent, or Firm*—Thomas E. Schatzel

[57] ABSTRACT

A speech synthesizer for developing a signal representing both voiced and fricative sounds from signals representing blocks of externally generated data, the synthesizer including a period counter for delineating a series of pitch periods each having a duration specified by the data, a source generator for developing an excitation signal having an amplitude specified by the data, the excitation signal being developed at the beginning of each of a series of constant duration sample intervals each with a random sign for fricative sounds, the excitation signal being developed at the beginning of each of the pitch periods for voiced sounds and a time multiplexed digital filter having characteristics specified by the data including circuit switching to control whether the filter functions as a second-order filter or a cascaded pair of first-order filters, the filter being driven by the excitation signal during the beginning of each of the sample intervals and by the output of the filter thereafter so as to develop the speech signal at the filter output.

10 Claims, 15 Drawing Figures

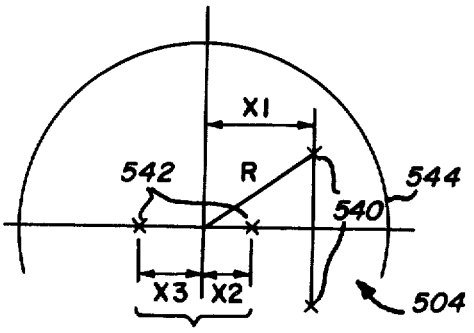
Fig_8C
(2)
Z-PLANE REPRESENTATION OF DIGITAL FILTER
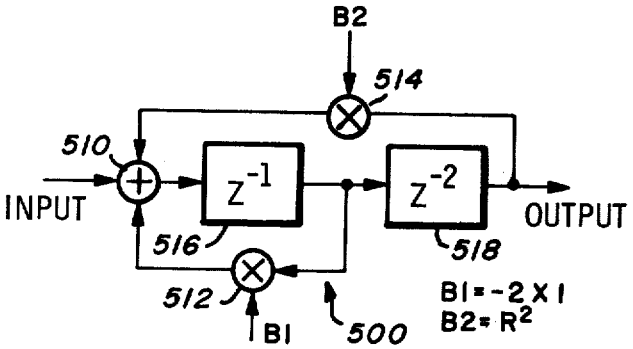
SECOND-ORDER DIGITAL FILTER SECTION
Fig_8A
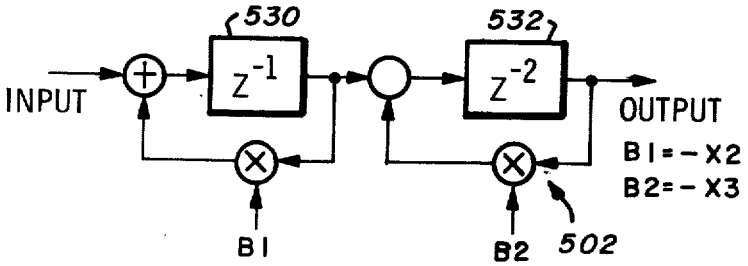
TWO FIRST-ORDER DIGITAL FILTER SECTIONS
Fig_8B
| ADDRESSES | | | | | | | | | | |
|---|---|---|---|---|---|---|---|---|---|---|
| 127 | 1 | 1 | 1 | 1 | 1 | 1 | 1 | 1 | 1 | COEFFICIENT VALUES |
| 126 | 1 | 1 | 1 | 1 | 1 | 1 | 1 | 1 | 0 | |
| 125 | 1 | 1 | 1 | 1 | 1 | 1 | 1 | 0 | 1 | |
| 124 | 1 | 1 | 1 | 1 | 1 | 1 | 1 | 0 | 0 | |
| 123 | 1 | 1 | 1 | 1 | 1 | 1 | 0 | 1 | 1 | |
| 122 | 1 | 1 | 1 | 1 | 1 | 1 | 0 | 1 | 0 | |
| 121 | 1 | 1 | 1 | 1 | 1 | 1 | 0 | 0 | 1 | |
| 6 | 0 | 0 | 0 | 1 | 1 | 0 | 0 | 0 | 0 | |
| 5 | 0 | 0 | 0 | 1 | 0 | 1 | 0 | 0 | 0 | |
| 4 | 0 | 0 | 0 | 1 | 0 | 0 | 0 | 0 | 0 | |
| 3 | 0 | 0 | 0 | 0 | 1 | 1 | 0 | 0 | 0 | |
| 2 | 0 | 0 | 0 | 0 | 1 | 0 | 0 | 0 | 0 | |
| 1 | 0 | 0 | 0 | 0 | 0 | 1 | 0 | 0 | 0 | |
| 0 | 0 | 0 | 0 | 0 | 0 | 0 | 0 | 0 | 0 | |
READ-ONLY MEMORY COEFFICIENT
Fig_9

SPEECH SYNTHESIZER

BACKGROUND OF THE INVENTION

1. Field of the Invention

The present invention relates generally to signal generators, and more specifically to a digital speech synthesizer suitable for integration within a single semiconductor chip.

2. Description of the Prior Art

Speech synthesis is a well developed art in which an electrical speech signal, suitable for operating a telephone, a loud speaker, or other electrical transducer, and representing a spoken word or message, is generated by an electronic apparatus in response to an analog or a digital electrical control signal. The controlling signal represents a coded form of the speech signal and may be derived continuously from an analog speech signal by some form of electrical spectrum analysis, such as the channel vocoder, or by mathematical analysis of a sampled speech signal, such as linear prediction coding.

A practical aim of speech synthesis is to reduce the information content of the speech signal, either to reduce the bandwidth or the capacity of a channel transmitting the speech signal or to reduce the size of the apparatus used for storing the speech signal in the case of fixed-message systems, such as annunciators.

In most forms of speech synthesis, the synthesizer is an electrical model of the human vocal apparatus containing filters which represent the acoustic resonances of various cavities in the vocal tract, such as the pharynx and the mouth, and energy sources, such as an impulse generator representing the glottis in the case of vowel sounds, or a broadband noise generator representing a turbulent construction in the vocal tract for fricative sounds. By separating speech production into its component parts consisting of energy source (e.g., glottis) and spectral filter (vocal cavities) information required to recreate speech synthetically is reduced (a) because of the relatively slowly changing parameters of the component parts compared to the rapidly varying speech waveform, and (b) because the separate parameters of amplitude and period or energy spectrum of the source and resonances of the spectral filter can be specified compactly.

In older art, the filter bands of the channel vocoder or the variable resonators of the formant vocoder require discrete components and precise adjustments which are not amenable to the size and cost reductions, as well as improved reliability, of digital integrated circuits. More recent art employs the digital filter which is ideally suited to integration, and which may be used to implement the spectral shaping functions of the channel or formant vocoder or the more complex shaping functions of the linear prediction synthesizer. In addition, the art uses similar combinations of energy source and spectral shaping function to produce signals representing animal sounds, such as dog barks, machinery noises, and a variety of sound effects. The types of filters and in particular the digital filter, which may be used for the spectral shaping required in speech synthesis, are also used in current art for more general filtering applications, such as tone detection or selection, or in separating or isolating specified frequency bands from a broad signal spectrum.

Current art employs the digital filter in a configuration called the "direct filter" for linear prediction synthesis. While the direct form may be controlled by the coefficients derived from linear prediction analysis without mathematical conversion of the coefficients, it is well known that the direct filter requires highly accurate coefficients and intermediate data, and thus complex circuit implementation, if it is to remain stable. Another configuration, called the "lattice filter" uses coefficients similar to those derived by linear prediction analysis. This configuration retains stability with a lower order of accuracy in the coefficients and intermediate data. However, the lattice filter is not amenable to general-purpose filter formulations which may be specified by frequency and gain functions, such as the channel and formant vocoders and a variety of signal processing applications.

It is known in the art that a polynomial expression derived from linear prediction analysis of a speech waveform, typically of 12th or 14th order, may be resolved into second-order factors by well-known computation techniques, and thus, a cascade of six or seven second-order filter sections may be used to provide identical filtering to a 12th or 14th-order direct filter. It is also known in the art that cascaded second-order sections are markedly less sensitive to coefficient accuracy than the equivalent direct filter, thereby allowing equivalent performance with a smaller number of bits per coefficient, and consequently resulting in lower operating speed and smaller arithmetic elements in circuit integration of the filter, as well as reduced size of data storage for the synthesizer control signals.

SUMMARY OF THE PRESENT INVENTION

A principal object of the present invention is to provide a speech synthesizer suitable for integration upon a single semiconductor chip.

Another object of the present invention is to provide a speech synthesizer requiring a minimum data overhead.

Briefly, the preferred embodiment of the present invention includes a timing generator for developing signals defining a series of sample intervals and signals for delineating six periods within each of the sample intervals, a buffer for double buffering externally generated speech defining data whereby a block of data may be received asynchronously while a previously supplied block of data is being used and a period-counting circuit for delineating a series of pitch periods each having a duration specified by the data. A source generator is included for developing an excitation signal the amplitude of which is specified by the data. The excitation signal is developed once each pitch period for voiced sounds and once each sample interval with randomly varying sign for fricative sounds. Also included is a ROM storing a plurality of filter coefficients retrieved responsive to the data and a time multiplexed digital filter operating either as a two-pole filter or two cascaded single pole filters as specified by the data, the filter having characteristics which are specified dynamically by the filter coefficients, the filter being driven by the excitation signal during the first period of each of the sample intervals and by the output of the filter during the other five periods of the sample interval. Coupled to the output of the filter during the first period of each sample interval, a D/A converter develops the speech signal. Further included is a repeat-counting circuit permitting the reuse of old data blocks.

A material advantage of the present invention is its amenability to integration.

Another advantage of the present invention is its versatility.

These and other objects and advantages of the present invention will no doubt become apparent to those of ordinary skill in the art after having read the following detailed description of the preferred embodiment illustrated in the several figures of the drawing.

IN THE DRAWING

FIGS. 8A and 8B are simplified block diagrams of the filter section shown in FIG. 7;

FIG. 8C is a Z-plane diagram representing the filter section shown in FIGS. 8A and 8B;

FIG. 9 is a table illustrating the filter coefficients stored in the ROM shown in FIG. 1;

DETAILED DESCRIPTION OF THE PREFERRED EMBODIMENT

Figure 1:
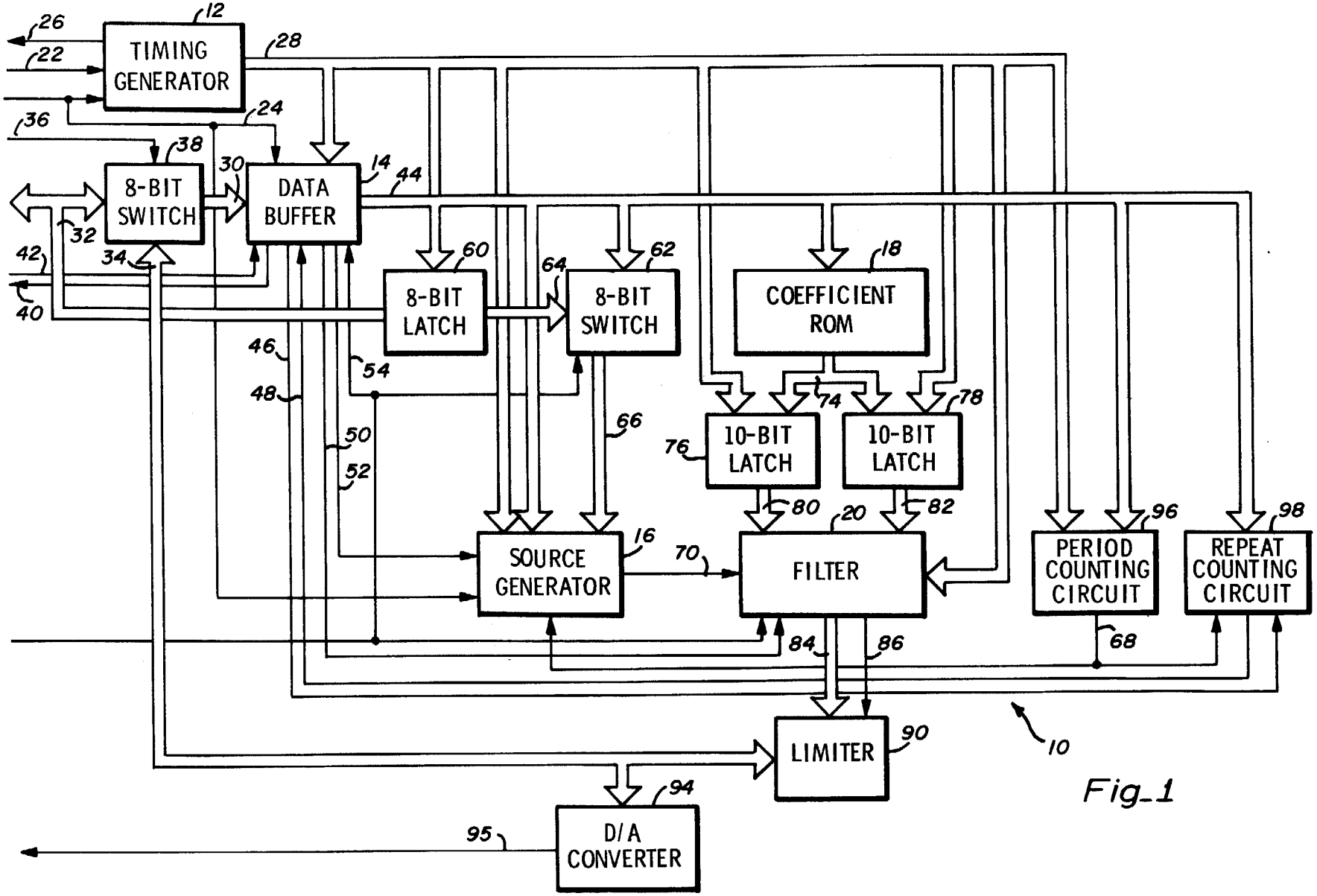
FIG. 1 is a block diagram generally illustrating the principal components of a speech synthesizer in accordance with the present invention.

The preferred embodiment of a speech synthesizer in accordance with the present invention is illustrated in FIG. 1 of the drawing generally designated by the number 10. The principal components of synthesizer 10 include a timing generator 12, a data buffer 14, a source generator 16, a coefficient read only memory, ROM, 18 and a digital filter 20. Timing generator 12 includes an oscillator which generates a basic clocking signal. From the clocking signal, a counter and a shift register, also included in generator 12, develop a signal which delineates a basic filter cycle, or sample interval. The interval, in the preferred embodiment, is 156 cycles of the clocking signal in duration. The counters and the shift register further develop six signals which divide the sample interval into six periods and six signals which delineate six subperiods within each of the periods.

Control of generator 12 is afforded by external signals which are coupled to the generator by means of a line 22 and a line 24. Line 22 is so connected to the oscillator of generator 12 that control of the frequency of the oscillator may be achieved by means of an external crystal connected thereto. Line 24 is connected to the shift register of generator 12 such that an external power-on-resetting signal clears the register. In an alternative embodiment, such a power-on-resetting signal is generated within synthesizer 10 responsive to a change in a power supply potential.

Also connected to generator 12 is an externally accessible line 26 upon which the generator develops the signal which defines the first of the major periods, permitting synchronization of external activity with that of synthesizer 10. Further, generator 12 is connected to a 15 line internal timing bus 28 upon which the generator develops the basic clocking signal also referred to as a phase-one clocking signal, an inverse of this signal referred to as a phase-two clocking signal, the sample interval signal, the six period signals and the six subperiod signals.

Data buffer 14 includes circuitry for double buffering data signals such that signals representing a block of data may be received asynchronously by the buffer while a block of previously received data is being utilized. More specifically, data buffer 14 includes a pair of random access memories, RAMs, a first one of which is connected to an 8-bit bus 30. Bus 30, along with an externally accessible 8-bit bus 32, an internal 8-bit output bus 34 and an externally accessible control line 36 are all connected to an 8-bit switch 38. Responsive to an inactive state of an external read signal developed on line 36, switch 38 couples the individual lines of bus 32 to corresponding lines of bus 30. The 38 couples the lines of bus 34 to corresponding lines of bus 32 when the read signal is active. Also connected to buffer 14 are a pair of externally accessible control lines 40 and 42. When a block of data is required by buffer 14, the buffer so indicates by means of a data request signal the buffer generates on line 40. Thereafter, a number of bytes, 8-bits each, of data representing signals may be generated on bus 32 a byte at a time and coupled to bus 30 by means of switch 38 to be individually clocked into the first RAM of buffer 14, each coincident with an externally generated write signal developed on line 42. At an appropriate time, the bytes of stored data are transferred from the first RAM to the second RAM of buffer 14.

The second RAM of buffer 14 is connected to an internal, 8-bit, data bus 44. Additionally, buffer 14 is connected to timing bus 28 and five control lines including a line 46, a line 48, a line 50, a line 52 and a line 54. At times controlled by the timing signals generated on bus 28 and a carry-out control signal developed on line 48, signals representing individual bytes of data stored in the second RAM of buffer 14 are developed on bus 44.

Buffer 14 also includes a pair of flip-flops and gates for decoding two bits of a specific byte of data developed on bus 44 from which the buffer develops a voice-/unvoice control signal on line 52 and a real-axis control signal on line 50.

Additionally, buffer 14 has an 8-bit latch connected between bus 30 and bus 44. In an alternative mode, evidenced by an active state of an externally generated mode signal developed on control line 54, signals on bus 30, which represent a single byte of data, are clocked into the latch of buffer 14 by the write signal developed on control line 42. Thereafter, the signals which represent the byte of data stored in the latch of buffer 14 are developed on bus 44 at the beginning of each sample interval.

Source generator 16 is selectively coupled to bus 32 by an 8-bit latch 60 and an 8-bit switch 62 or to a portion of bus 44 by switch 62. Latch 60 has eight data inputs connected to the respective eight lines of bus 32, eight data outputs connected to corresponding ones of eight lines which form a bus 64 and a clock input which is connected to timing bus 28. Switch 62 has a first set of eight inputs connected to the respective eight lines of bus 64, a second set of eight inputs, a set of eight outputs connected to the respective eight lines which form a bus 66 and a control input connected to mode control line 54. The four higher order lines of the second set of inputs of switch 62 are connected to a low logic level, the four lower order lines being connected to the corresponding four lower order lines of bus 44.

When the mode signal developed on line 54 is inactive, switch 62 is in a state in which it couples signals developed on the lower order four lines of data bus 44 to generator 16 by means of bus 66. When switched to another state by an active mode signal on line 54, switch 62 couples to bus 66 the data byte representing signals which are developed on bus 32 and latched by latch 60 responsive to the timing signals developed on timing bus 28.

In addition to the eight inputs connected to bus 66, source generator 16 has four inputs connected to the respective four higher order lines of bus 44, four timing inputs connected to lines of timing bus 28, three control inputs connected respectively to line 24, line 52 and a line 68 and an output connected to a line 70.

Source generator 16 includes a counter and a shift register which periodically develop a signal which specifies an excitation amplitude on line 70 from data signals developed on buses 44 and 66. The data signals developed on buses 44 and 66 represent, in scientific notation, an excitation amplitude wherein the nibble, 4-bits, obtained from signals developed on bus 44 represents the characteristic and the nibble or byte obtained from signals developed on bus 66 represents the mantisa of the desired excitation amplitude. The counter, which receives the data signals representing the characteristic, so enables clocking of the shift register, which receives the mantisa, that the excitation signal developed on line 70, from signals clocked out of the shift register, is in the form of a serial bit stream representing the amplitude in standard binary notation, as opposed to scientific notation.

Once at the beginning of each sample interval the excitation signal is developed on line 70 by source generator 16 unless the voice/unvoice signal developed on line 52 is in the voice state. In this latter case, the excitation signal is developed on line 70 once at the beginning of each of a series of pitch periods defined by the state of the carry-out signal developed on line 68. When the mode signal developed on line 54 is inactive and the voice/unvoice signal developed on line 52 is in the unvoice state, the sign bit portion of the excitation signal is varied in a random fashion for each sample period.

Coefficient ROM 18 has a plurality of storage locations each storing a coefficient which with an associated one of the coefficients defines a second order filter. Further, ROM 18 has addressing inputs connected to data bus 44 and data outputs connected to a ten line bus 74 such that the ROM develops signals on bus 74 which represent the coefficient addressed by data signals developed on bus 44.

A pair of 10-bit latches 76 and 78 couple ROM 18 to filter 20. Latch 76 has ten data inputs connected to the respective lines of bus 74, ten data outputs connected to corresponding ones of ten lines which form a bus 80 and a clocking input connected to timing bus 28. Similarly, latch 78 has ten data inputs connected to bus 74, ten data outputs connected to ten lines which form a bus 82 and a clocking input connected to bus 28.

Filter 20 has inputs connected to bus 28, bus 80 and bus 82 and to lines 50, 54 and 70 and outputs connected to a sixteen line bus 84 and a line 86. Filter 20 includes a digital filter section which, under the control of a real-axis control signal developed on line 50, may be configured either as a second-order filter section or two cascaded first-order filter sections. The transfer characteristics of the filter section are established by the signals representing the pair of filter coefficients developed on buses 80 and 82.

The filter section is time multiplexed over the six periods defined by the timing signals developed on bus 28 such that the filter section provides filtering equivalent to a twelfth-order filter, when the mode signal developed on line 54 is inactive, or equivalent to three, fourth-order filters otherwise. This is accomplished by driving the input of the filter with the excitation signal developed on line 70 during the first period and with the output of the filter section during subsequent periods. During the first period the output of the filter section is coupled to the lines of bus 84 and a clocking signal is developed on line 86 coincident therewith.

A limiter 90 is connected to buses 84 and 34 and to line 86. When the logic levels developed on the five most significant lines of bus 84 are all similar, responsive to the clocking signal developed on line 86, limiter 90 is operative to latch the levels of the signals developed on the fifth through twelfth highest-order (eight) lines of bus 84 to develop bus 34 driving signals. When the logic levels are not all similar an overflow of the 8-bit field has occurred. In this case the level of the signal developed on the fifth most significant line of bus 84 is latched for driving the seven least significant lines of bus 34 and the signal is inverted and latched to drive the highest-order line of bus 34.

Connected between bus 34 and an externally accessible line 92 is an 8-bit digital to analog, D/A, converter 94. Preferably, D/A converter 94 is of the R-2R ladder variety.

Synthesizer 10 also includes a period-counting circuit 96 and a repeat-counting circuit 98. Both counting circuits 96 and 98 have preset inputs connected to data bus 44. Circuit 96 also has a clock input and a pair of load inputs connected to timing bus 28 and a period counter carry-out output connected to line 68. Circuit 98 also has a load input connected to line 46, a clock input connected to line 68 and a counter carry-out output connected to line 48.

The operation of speech synthesizer 10 is controlled by blocks of data supplied the synthesizer by external means, such as a microprocessor. When the synthesizer is ready to receive a block of data, it generates a data request signal on line 40. Thereafter, the microprocessor may transfer to buffer 14 a block of data a byte at a time by generating signals on bus 32 which represent a byte of data while generating a write signal on line 42 and maintaining an inactive state of the read signal on line 36.

In general, each of the blocks of data will consist of from two to twelve bytes of filter coefficients and from two to four bytes of additional information, depending upon whether synthesizer 10 is to generate a speech signal or to perform spectral filtering.

The bytes of data, stored in buffer 14, are transferred one byte at a time under the control of timing generator 12. Generator 12 develops timing signals on bus 28 which specify a byte of data stored in buffer 14 and a time at which the buffer is to generate signals representing the selected byte on bus 44. The timing signals also specify whether source generator 16, coefficient ROM 18, period-counting circuit 96 or repeat-counting circuit 98 is to receive the byte and the time at which the byte is to be accepted.

Period-counting circuit 96, repeat-counting circuit 98, source generator 16 and filter 20 are associated with the generation of wave-form signals, and, in particular, speech signals. The voiced sounds of speech, such as vowels, are characterized by a periodicity called the pitch period. When synthesizing signals representing such sounds, the length of this period is defined by a byte of data that is transferred from buffer 14 to period-counting circuit 96. In addition, since the characteristics of a speech signal may remain substantially unchanged over several pitch periods, it is possible to repeat this period without changing the spectral shaping characteristics of filter 20 or the characteristics of source generator 16. This results in a considerable savings in the amount of control data that need be transmitted between the microprocesser and buffer 14. To accomplish the repetition of such a pitch period, a byte specifying the number of times the period is to be repeated is transferred from buffer 14 to repeat-counting circuit 98.

The generation of signals representing voiced sounds requires that the excitation signal be in the form of a single inpulse at the beginning of each pitch period which duplicates the opening of the glottis. The impulse is used to excite filter 20 which in turn shapes the energy spectrum of the impulse. The spectrum consists of harmonics of the pitch period extending over a frequency band inversely proportional to the time duration of the impulse. In the preferred embodiment the width of the impulse is 100 microseconds, resulting in the generation of spectral energy up to about 4,500 hertz. The average amplitude of a speech wave form is determined by the amplitude of the impulse. Therefore, a byte specifying an amplitude number is transferred from buffer 14 to source generator 16 at a time in the control cycle determined both by the timing signals generated by timing generator 12 on bus 28 and the carry-out signal generated by period-counting circuit 96 on line 68.

A complete filter cycle, or sample interval, lasts 100 microseconds. At successive periods within the interval, a byte for addressing coefficent ROM 18 is transferred from buffer 14 and timing signals are generated on bus 28 activating the ROM while at the same time registering the output of the ROM in one of the two latches 76 or 78. During each period of a sample interval two different filter coefficients, defining a second-order filter, are placed one in each of the two latches 76 and 78. Thus, a sequence of six periods defines a twelfth-order filtering or spectral-shaping function which has been found adequate to create good quality synthesized speech. Following the sample interval, after the complete filtering has occurred, the output sample from filter 20 is transferred to a limiter 90 under the control of the timing signal generated on line 86. The output sample, which is held in limiter 90, drives a D/A converter 94. Responsive to a sequence of such samples, D/A converter 94 develops a time-varying sound-representing signal on line 95.

A period-counting circuit 96 and a repeat-counting circuit 98 are also used to control data buffer 14. Each carry-out signal developed on line 68 by period-counting circuit 96 delineates the end of a pitch period and decrements the repeat number stored in repeat-counting circuit 98. When the repeat number has been decremented to zero, a carry-out signal is developed on line 48 indicating the end of a frame and activating the transfer of data within data buffer 14 for a new frame. The actual transfer of data within buffer 14 is also dependent on the state or previous activation of the write signal generated on line 42 by the microprocessor.

Signals representing another class of speech sounds, called "fricative" sounds, of the type associated with the "s" in "sound", are created when filter 20 is excited by an excitation signal representing noise-like impulses. In the case of fricative sounds, a period is not defined by a single impulse at its beginning, as in the pitch period of a vowel sound. Rather, signals representing fricative sounds are developed from a sequence of impulses of constant amplitude and of random sign, each impulse occurring once at the beginning of each 100 microsecond sample interval. However, fricative sounds have a defined duration which is controlled by period-counting circuit 96 and repeat-counting circuit 98. The average amplitude of the fricative energy source is controlled by a byte of data transferred to source generator 16 in the same manner as for the pitch impulse previously described.

In another mode, speech synthesizer 10 operates as an externally-controlled, general-purpose spectral filter. Such filters are useful, for instance, as tone detectors for use in modems and as data decoders for use in devices employing frequency-shift keying or multiple-tone switching. Furthermore, under external control, the synthesizer may be instantly programmed for different data rates or data coding schemes. Another application of the synthesizer is to separate energy bands of a spectrum, such as the low, mid and high bands of the speech spectrum, for use in certain speech recognizing devices.

When the synthesizer is employed as a spectral filter, it is necessary to supply digital samples of some external wave form (which may be created, for example, by a microphone in connection with an analog to digital converter) and to retrieve the filtered output samples for storage or analysis. This is facilitated by switch 62. Normally switch 62 connects the output of data buffer 14 to source generator 16 to develop an excitation signal for driving filter 20. However, when an external mode signal developed on line 54 is active, switch 62 transfers a sample signal from external bus 32 to source generator 16 to develop the filter 20 driving excitation signal.

It is implied by the foregoing that samples of a continuous signal may be supplied regularly by an external means such as a microprocessor. To faciliate this operation, a synchronizing signal, occurring at the sample microsecond rate, is generated by timing generator 12 on line 26. This signal may be used by the microprocessor as an interrupting signal or a status-indicating signal to request a new signal sample.

At the end of each 100 microsecond processing interval, the filtered output sample is registered in limiter 90. The registered signal may be accessed by the microprocessor by generating a read signal on line 36, which switches the output sample to bus 32 through switch 38. Again, the signal on line 26 serves to synchronize the operation.

Figure 2A:
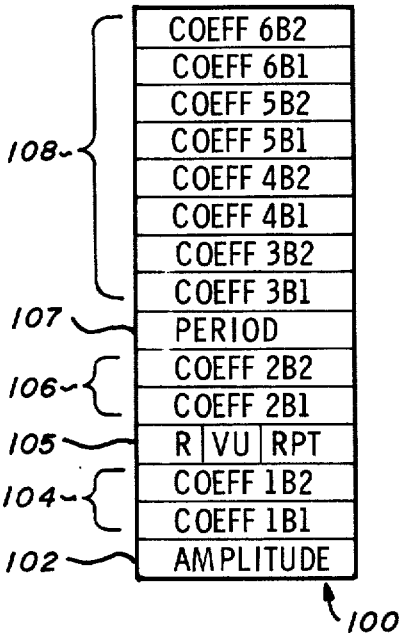
FIGS. 2A and 2B are tables illustrating the sequence and format of data used to control the speech synthesizer shown in FIG. 1.
Figure 2B:
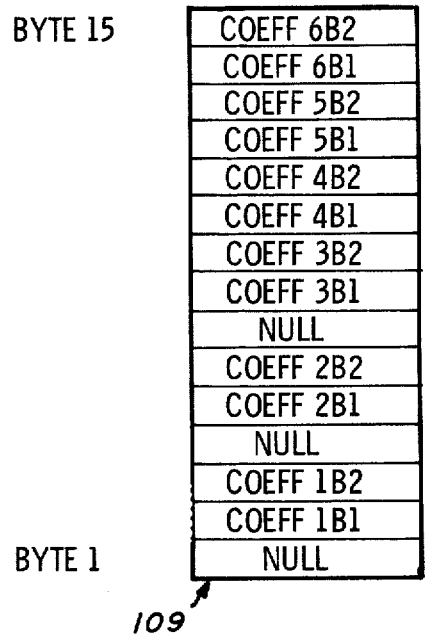

Turning now to FIG. 2A and 2B of the drawing, two tables are shown illustrating the sequence and format of data which may be used to control the operation of the speech synthesizer, shown in FIG. 1, in either of the alternative operating modes of signal synthesis and spectral filtering. In FIG. 2A, the first table, generally designated by the number 100, shows those bytes of data used in the synthesis mode, including a first byte 102 which specifies the desired filter excitation amplitude. This is followed by the first two filter-coefficient defining bytes 104. Next is a byte 105 which controls the generation of the real-axis control signal and the state of the voice/unvoice control signal and specifies the repeat count. This is followed by the next two coefficient bytes 106, a period-count byte 107 and, finally, the remaining coefficient bytes 108. The first three coefficient pairs are necessarily interleaved with the other parameters because the bytes which control amplitude, period, etc. are gated on to the internal data bus during the first subperiod of the first three periods, while the coefficient pairs are gated on to the data bus during the second and fourth subperiods of each period.

Note, the twelve filter coefficients shown at 104, 106 and 108 are those typically required for linear-prediction synthesis using a twelfth-order filter. For a tenth-order filter or for formant synthesis using only a sixth-order filter, it is only necessary to supply zero values for the unused coefficient bytes.

When the signal processor is operated in the spectral filtering mode, it is still necessary to transmit a set of filter coefficients, as shown in FIG. 2B by a table 109. In general, these coefficients remain unchanged throughout a filtering operation. The values of period, amplitude, etc. have no significance and are set to zero, it being observed that the real-axis control bit must be zero unless it is desired to specify a real-axis filtering function for the last stage of the filter, that the voice-/unvoice bit must be zero to prevent randomization of the sample, and the four most significant bits of amplitude must be zero unless it is desired to scale the signal sample. After the initial coefficients have been transferred, the mode control signal generated on line 54, shown in FIG. 1, is raised and subsequent data transfers consist of signal samples.

Figure 3:
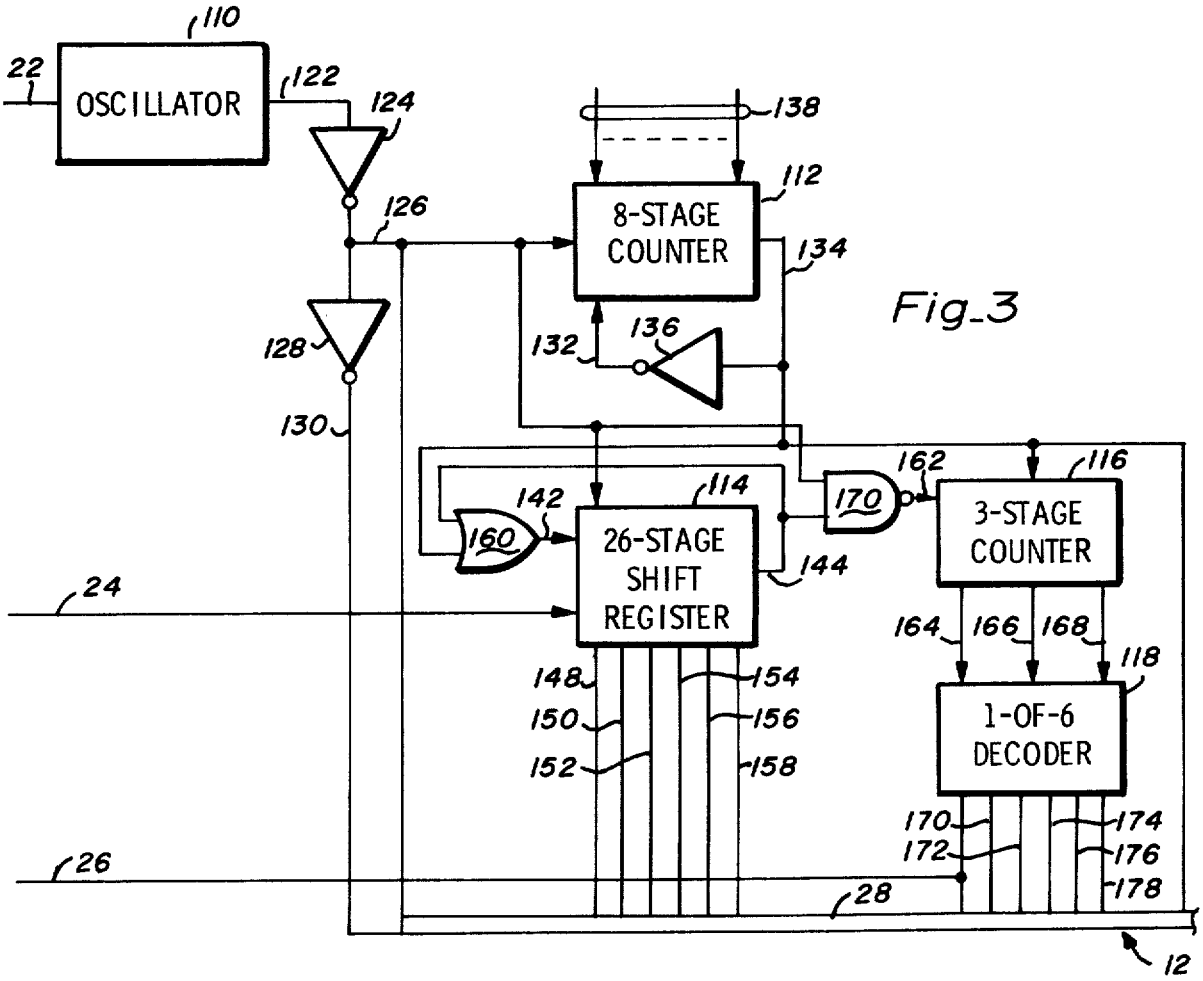
FIG. 3 is a block diagram further illustrating the timing generator shown in FIG. 1.

Referring now to FIG. 3 of the drawing, a block diagram is shown further illustrating timing generator 12. Generator 12 includes an oscillator 110, an 8-stage counter 112, a 26-stage shift register 114, a 3-stage counter 116 and a 1-of-6 decoder 118. Oscillator 110 has an input connected to line 22 for connection to an external crystal and an output connected to a line 122. Oscillator 110 is of conventional design generating on line 122 a signal having a frequency which is controlled by the external crystal connected to line 22.

Line 122 is coupled by an inverter 124 to a line 126 of bus 28 which is coupled by an inverter 128 to a line 130, also of bus 28. Inverters 124 and 128 develop on lines 126 and 130 the phase-one and phase-two clocking signals, respectively, from the oscillator signal.

Counter 112 has a clock input connected to line 126, a load input connected to a line 132, eight preset inputs and a carry output connected to a line 134, line 134 being coupled to line 132 by an inverter 136. The preset inputs of counter 112, which are collectively designated 138, are so connected to high and low logic levels that the counter is preset to a sum of 100 by a preset signal developed on line 132.

Register 114 has a shift input connected to a line 142, a clear input connected to line 24, a clock input connected to line 126 and a shift output connected to a line 144. Additionally, register 114 has taps following the first, fourth, eighth, twelfth, sixteenth and twentieth stages which are connected to a line 148, a line 150, a line 152, a line 154, a line 156 and a line 158, respectively, all of bus 28. Line 114 is connected to one input of an OR gate 160 having another input connected to line 134 and an output connected to line 142.

Counter 116 has a clock input connected to a line 162, a clear input connected to line 134 and a first, a second and a third stage data output connected respectively to a line 164, a line 166 and a line 168. Having a first input connected to line 126 and a second input connected to line 144, a NAND gate 170 has an output connected to line 162.

Decoder 118 has three inputs connected to respective ones of the lines 164, 166 and 168 and six outputs connected, respectively, to line 26, a line 170, a line 172, a line 174, a line 176 and a line 178, all of bus 28.

Initially, register 114 is cleared by the power-on-reset signal developed on line 24. At some later time, the clocking by oscillator 110 of counter 112 causes the counter to reach a count of 256 causing the generation of a carry-out signal on line 134. The carry-out signal presets counter 112 to the number 100, loads register 114 with a signal representing signal high logic level bit and resets counter 116. Thereafter, as register 114 is clocked by oscillator 110, the single bit will circulate through the register appearing as signals developed at successive taps and finally the output thereof. At this latter time, counter 116 will be clocked by the bit signal and the bit signal will be reloaded into register 114. As oscillator 110 clocks register 114, it clocks counter 112. Thus, as counter 116 reaches the count of six, counter 112 reaches the count of 256 resetting counter 116 and preloading counter 112. As counter 116 counts from zero to 6, decoder 118 decodes the count to develop on bus 28 the six period signals. Additionally, as the bit circulates in register 114, the register generates the six subperiod signals, also on bus 28.

In the preferred embodiment, a crystal, resonant at 1.56 megahertz is employed to provide 156 phase-one clocking cycles in a 100 microsecond filter cycle, or sample interval. The 100 microsecond interval provides a 5,000 hertz bandwidth, a bandwidth found adequate for good quality synthetic speech and good spoken word recognition. Additionally, telephone switching tones and the majority of modem signaling tones lie within this bandwidth. The 156 clock cycles permit 156 bits to be processed by the filter during a complete filter cycle. In other words, a 10-bit filter coefficient may be multiplied by a 16-bit intermediate data magnitude to provide a 26-bit product in each of the six periods.

Figure 4:
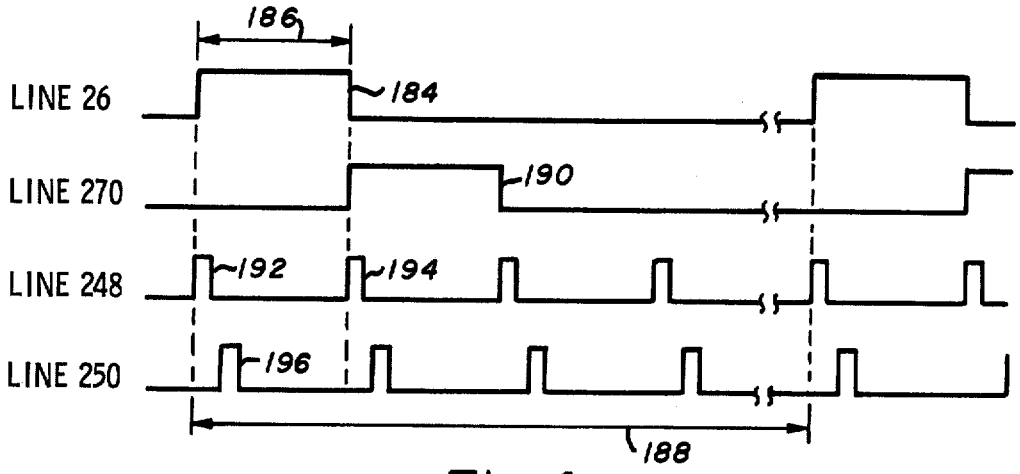
FIG. 4 is a timing diagram illustrating signals developed by the timing generator shown in FIG. 3.

A timing diagram illustrating representative ones of the signals which are generated by timing generator 12 on bus 28 is shown in FIG. 4 of the drawing. The first period signal can be seen at 184 to define an interval 186 which is 26 clock-signal cycles in duration and which occurs at the beginning of each of the 156 clock-signal cycle, 100 microsecond wide sample interval 188. The second period signal defines, following each of the first period intervals, a similar size interval 190. Further, the first subperiod signal can be seen to be at a high logic level during an interval at the beginning of each period including an interval 192 at the beginning of the first period and an interval 194 at the beginning of the second period.

The second subperiod signal 196 is high during an interval which occurs four-clock signal cycles after each of the first subperiod signals 192. For clarity, the interval over which each of the subperiod signals is high is exagerated, the correct pulse duration corresponding to a one-cycle signal interval.

Figure 5:
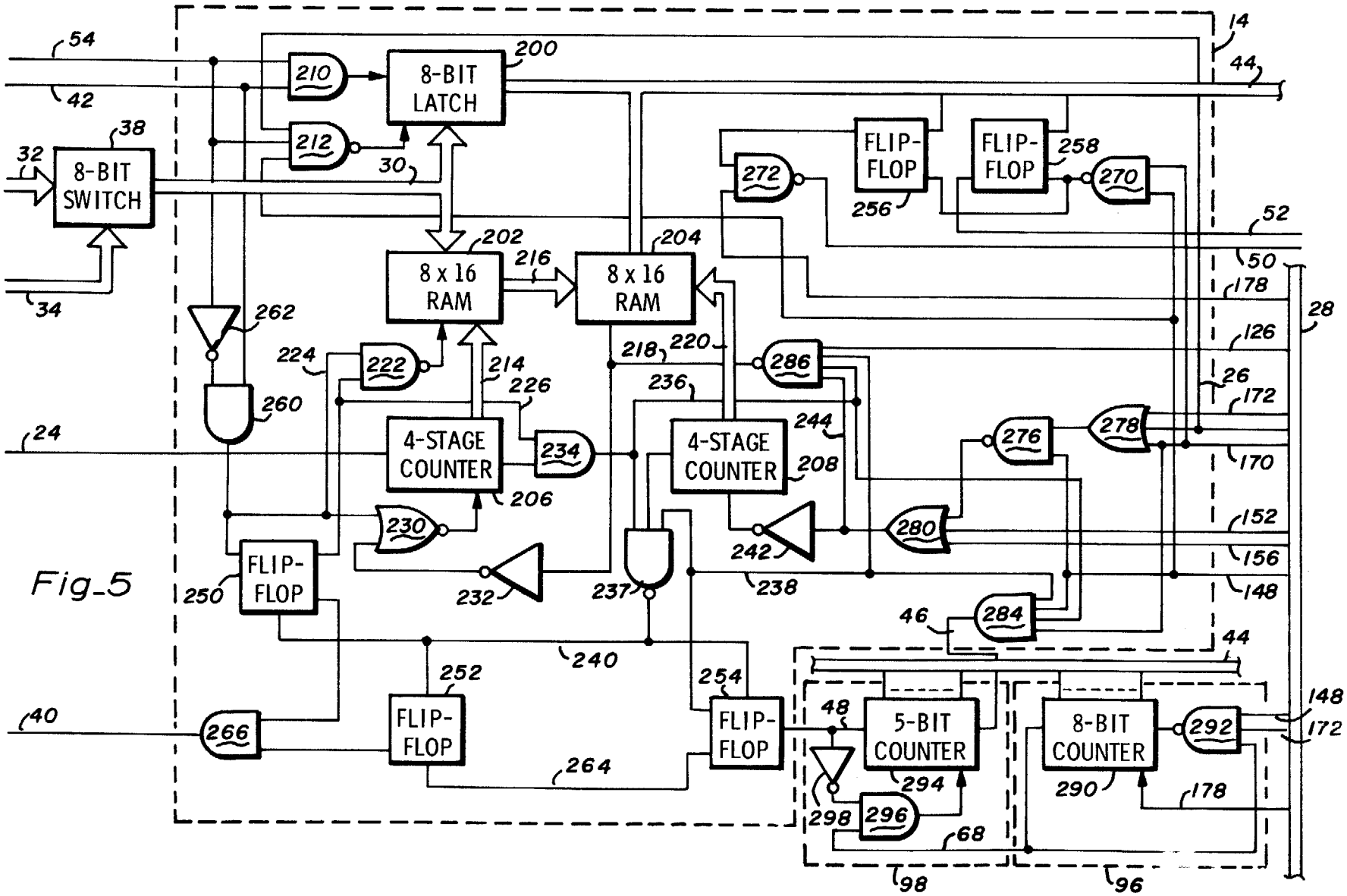
FIG. 5 is a block diagram further illustrating the data buffer shown in FIG. 1.

Data buffer 14, period-counting circuit 96 and repeat-counting circuit 98 are illustrated in greater detail in FIG. 5 of the drawing. The principal components of buffer 14 include an 8-bit latch 200, a pair of 8-bit by 16-bit RAMS 202 and 204, and a pair of 4-stage address counters 206 and 208. Latch 200 has a clock input, an enable output, eight data inputs connected to corresponding lines of bus 30 and eight data outputs connected to corresponding lines of bus 44. The clock input is connected to the output of an AND gate 210 having an input connected to line 54 and another input connected to line 42. The output enable is connected to the output of an NAND gate 212 having a first input connected to line 26, a second input connected to line 54 and a third input connected to line 148.

RAM 202 has eight data inputs connected to corresponding lines of bus 30, a read/write input, four address inputs connected to respective lines of a four line bus 214 and eight outputs connected to corresponding ones of eight data inputs of RAM 204 by an eight line bus 216. Additionally, RAM 204 has a read/write input connected to a line 218, eight data outputs connected to corresponding lines of bus 44 and four address inputs connected to corresponding lines of a four line bus 220. The read/write input of RAM 202 is connected to the output of a NAND gate 222 having an input connected to a line 224 and another input connected to line 226.

Counter 206 has a clear input connected to line 24, a clock input connected to the output of a NOR gate 230 having an input connected to line 224 and another input coupled by an inverter 232 to line 218. Further, counter 206 has four data outputs connected to corresponding lines of bus 214 and a carry output connected to one input of an AND gate 234 having another input connected to line 226 and an output connected to a line 236.

Counter 208 has a carry output connected to a first input of a NAND gate 237 having a second input connected to line 236, a third input connected to a line 238 and an output connected to a line 240. Additionally, counter 208 has four data outputs connected to corresponding lines of bus 220 and a clock input connected by an inverter 242 to a line 244.

Also included in data buffer 14 are five flip-flops 250, 252, 254, 256 and 258. Flip-flop 250 has a clock input connected to the output of an AND gate 260 having an input connected to line 42 and another input coupled by an inverter 262 to line 54. Additionally, flip-flop 250 has a reset input connected to line 240 a non-inverted data output connected to line 226 and an inverted-data output. Flip-flop 252 has a reset input connected to line 240, a set input connected to a line 264 and an inverted data output. An AND gate 266 has a pair of inputs connected to respective ones of the inverted data outputs of flip-flops 250 and 252, the gate having an output connected to line 40.

Flip-flops 256 and 258 have clock inputs connected to the output of a 2-input NAND gate 270 having inputs connected, respectively, to line 170 and line 148. Additionally, flip-flop 156 has a data input connected to the highest order line of bus 44 and a data output connected to one input of a NAND gate 272 having another input connected to line 178 and an output connected to line 50. Flip-flop 258 also has a data input connected, in this case, to the second highest order line of bus 44 and a data output connected to line 52.

A 2-input NAND gate 276 has a first input connected to line 148 and a second input connected to a 3-input OR gate 278 having inputs connected respectively to lines 172, 26 and 170. The output of gate 276 is connected to one input of a 3-input OR gate 280 having a second input connected to line 152, a third input connected to line 156 and an output connected to line 244. A 4-input AND gate 284 has four inputs one of which is connected to each of the lines 238, 148, 236 and 170 and an output connected to line 46. A 4-input NAND gate 286 has four inputs each of which is connected to a respective one of the lines 126, 238, 236 and 244 and an output connected to line 218.

Period-counting circuit 96 includes an 8-bit counter 290 having a load input connected to the output of a 3-input NAND gate 292 inputs of which are connected to lines 148, 172 and 178, respectively. Further, counter 290 has a clock input connected to line 178, eight data inputs connected to the respective lines of bus 44 and a carry output connected to line 68.

Repeat-counting circuit 98 includes a 5-bit counter 294 having a load input connected to line 46, five data inputs connected to the corresponding five lower-order lines of bus 44, a carry output connected to line 48 and a clock input. The clock input of counter 294 is connected to the output of an AND gate 296 having one input connected to line 68 and another input coupled by an inverter 298 to line 48.

The power-on-reset signal developed on line 24 clears counter 206 to assure that it is synchronized for the first data transfer and that an internal data available signal developed on line 236 is at a low logic level. A read/write signal, developed at the read/write input of RAM 202 by gate 222, is normally high, placing the memory in the read mode. After signals representing the first byte of a block of data are generated on bus 32, the microprocessor, or other control means, develops a write signal on line 42 which places RAM 202 in the write mode causing it to store the data byte. When the write signal on line 42 goes low, address counter 206 is advanced and the data transfer process continues until RAM 202 is full, evidenced by a carry-out signal generated by counter 206 at an input of gate 234. The completion of the external data transfer changes the state of the internal data available signal developed on a line 236. The signal is combined with a transfer signal developed on line 238 to develop a signal which permits a block of data to be transferred from RAM 202 to RAM 204 under synchronous control of the period signals and subperiod signals developed on bus 28.

Control of RAM 204 and its address counter 208 is always synchronized with internal timing signals. When data is being written into RAM 204 it is necessary to read data from RAM 204 for transfer on internal data bus 44. This is controlled by a read/write signal which is developed on line 218. The read/write signal is in the write mode only when the clock phase-one signal is high, being in the read mode otherwise, when the clock phase-two signal is high. Further, the read/write signal developed on line 218 is in the write mode only during the second and fourth subperiods and during the first subperiod of the first three periods. Under other conditions, with the signals developed on line 238 or line 236 low, the signal developed by gate 286 is low placing RAM 204 in a continuous read mode. During data transfers between RAM 202 and RAM 204, address counters 206 and 208 are synchronously advanced by the clocking signals developed by gates 230, 280 and 286. Completion of data transfer clears the transfer signal developed on line 238 by resetting flip-flop 254. The resetting of flip-flop 254 also enables the external data request signal developed on line 40 signalling the microprocessor, or similar means, that another block of data may be sent to RAM 202.

While data is being transferred to RAM 204, an initial period count is loaded into counter 290, a repeat count is loaded into counter 294 and voice/unvoice and real-axis control signal are clocked into flip-flops 258 and 256. Period counter 290 is decremented once each 100 microsecond sample interval until the carry-out signal developed on line 68 enables the reloading of the period counter from data stored in RAM 204 and decrements repeat counter 294. When counter 294 has reached the zero state, a carry out signal is generated on line 48 asserting the transfer signal developed on line 238 reinitiating the transfer cycle between RAM 202 and RAM 204, provided that the internal data available signal developed on line 236 is active. Note that if the internal data available signal is inactive, signal processing continues normally with the exception that repeat counter 294 is inhibited until after the next external data transfer to RAM 202.

When the speech synthesizer is in the spectral filtering mode, as evidenced by a high signal level developed on line 54, data transfers on external bus 32 are registered in latch 200, which is also clocked by the normal write signal developed on line 42, latch 200 retaining the signal samples for processing by the filter. In this mode, it is necessary to initially transfer filter coefficients to RAM 204, which is accomplished in the normal manner with the mode signal inactive.

Figure 6:
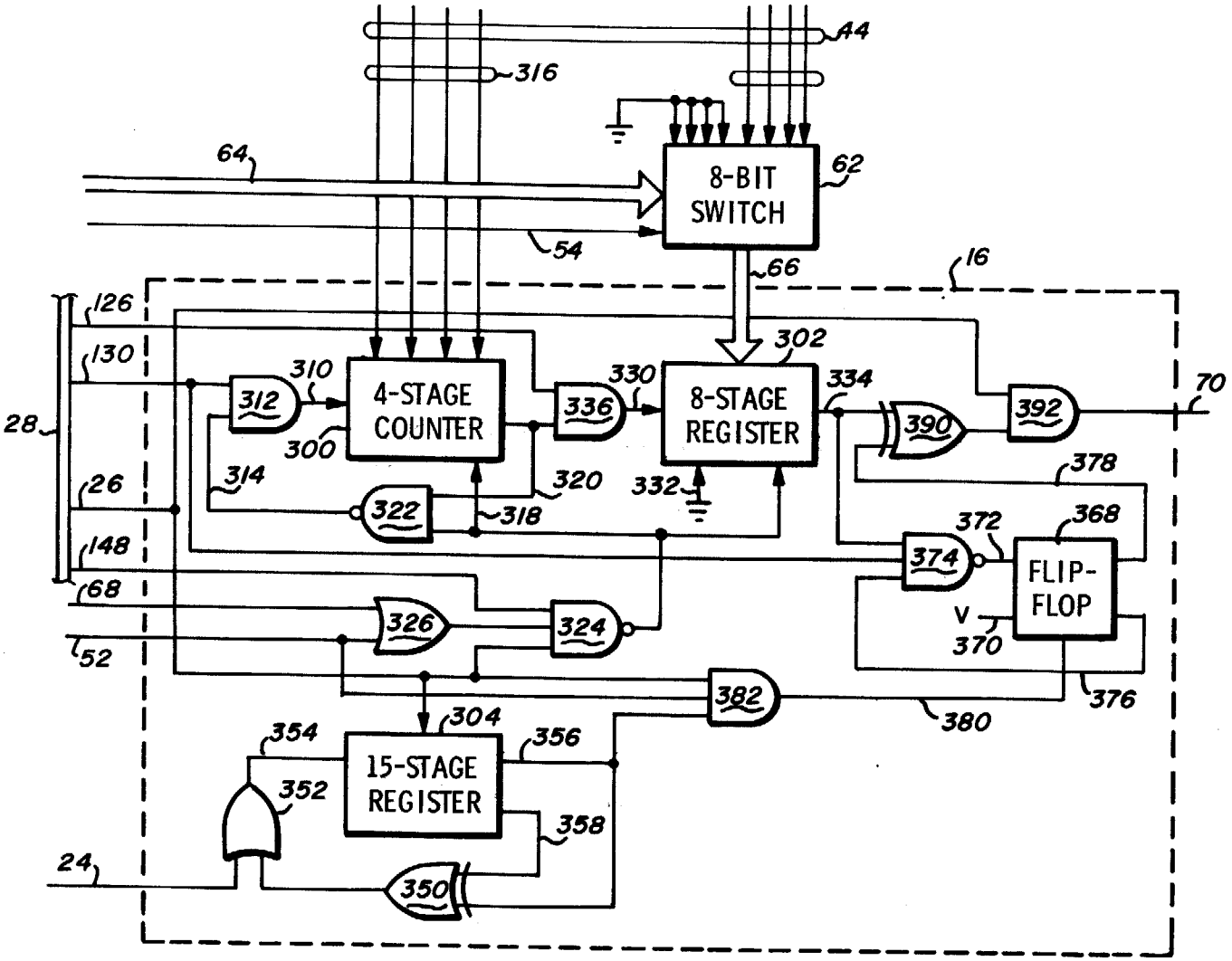
FIG. 6 is a block diagram further illustrating the source generator, period-counting circuit and repeat-counting circuit shown in FIG. 1.

Referring now to FIG. 6 of the drawing, a more detailed block diagram illustration of source generator 16 is depicted. Generator 16 includes a 4-stage counter 300, an 8-stage shift register 302 and a 15-stage shift register 304. Counter 300 has a clock input connected by a line 310 to the output of an AND gate 312 having an input connected to line 130 and another input connected to a line 314. Additionally, counter 300 has four data input lines connected to corresponding lines of bus 316 which includes the four higher-order lines of bus 44, a load input connected to a line 318 and a carry output connected to a line 320. Line 318 and 320 are connected to separate inputs of a 2-input NAND gate 322 having an output connected to line 314. Additionally, line 318 is connected to the output of a NAND gate 324 having a first input connected to line 148, a second input connected to line 26 and a third input connected to the output of a 2-input OR gate 326 the inputs of which are connected, respectively, to lines 68 and 52.

Register 302 has a clock input connected to a line 330, a shift input connected by a line 332 to circuit ground, a load input connected to line 318, and eight data inputs connected by corresponding lines of bus 66 to switch 62 and a shift output connected to a line 334. Line 330 is connected to the output of an AND gate 336 having an input connected to line 26 and another input connected to line 320.

With an exclusive OR gate 350 and a 2-input OR gate 352, register 304 forms a quasi-random bit generator. Register 304 has a shift input connected by a line 354 to the output of gate 352, a clock input connected to line 26, a shift output connected by a line 356 to an input of gate 350 and a tap output connected by a line 358 to another input at gate 350. The tap follows a stage chosen so as to provide a suitable string of random bits. The output of gate 350 is connected to an input of gate 352, the other input of which is connected to line 24.

Source generator 16 further includes a flip-flop 368 having a data input connected to a high logic level by a line 370 and a clock input connected by a line 372 to the output of a NAND gate 374 having three inputs connected, respectively, to line 334, line 130 and a line 376. Flip-flop 368 also has a non-inverted data output connected to a line 378, an inverted data output connected to line 376 and a reset input connected by a line 380 to the output of an AND gate 382 having three inputs each connected to a respective one of lines 26, 52 and 356. Line 378 and line 334 each are connected to an input of an exclusive OR gate 390 which has an output connected to one input of a 2-input AND gate 392 having a second input connected to line 26 and an output connected to line 70.

When the signal level developed at the output of gate 326 is high, during the first subperiod of the first period, gate 324 loads signals representing an 8-bit amplitude specifying data byte from bus 44 into counter 300 and shift register 302. The signals representing the four most significant bits are loaded into counter 300 and those representing the four least significant bits are loaded by way of switch 62 into the lower part of register 302. The amplitude byte is in scientific notation wherein the four least significant bits specify a mantisa or magnitude and the four most significant bits specify a characteristic or exponent. The characteristic defines the number of shifts, or delays, that will be applied to the mantisa before it appears as the excitation signal on line 70. Clocking pulses developed on line 126 are inhibited from clocking register 302 by gate 336 until the exponent has been counted down to zero. After a carry-out signal (minimum count) has been generated by counter 300, the mantisa bits will be clocked out of register 302 as a serial bit stream excitation signal on line 334. The first period delineating signal developed on line 26 is gated with the serial bit string signal in gate 392 such that the serial bit string signal is only coupled to line 70 to drive the filter during the first period. In the case where the characteristic is zero, shifting starts immediately, and mantisa bits will be registered at the lowest or least significant position of a 16-bit intermediate data field. When the characteristic is 11, mantisa bits are delayed and appear in the next to most significant position of the field (reserving the most significant bit for the sign) and thus, may cover more than a 60 db amplitude range. The mantisa bits alone define a narrower range, covering 12 db in approximately 1 db steps. Such a range of amplitude is more than adequate, as it has been found that good quality synthetic speech requires only three bits each for the characteristic and the mantisa.

As previously indicated, the loading of the amplitude specifying data byte into counter 300 and register 302 is controlled by gate 326 which is driven by the carry-out signal developed by the period counting circuit on line 68 and a voice/unvoice signal developed on line 52. For voiced speech the signal developed on line 52 is at a low level and the amplitude byte is loaded into counter 300 and register 302 under the control of the carry-out signal developed on line 68. During other sample intervals, no excitation signal is developed at the output of gate 392 on line 70 because zeros are constantly being shifted out of register 302. Thus, an impulse is applied to the digital filter only at the beginning of each pitch period.

For unvoiced or fricative sounds, the voice/unvoice signal coupled to gate 326 by line 52 is at a high level so that the amplitude specifying data byte is loaded in response to the signal developed by gate 324 during each first subperiod of each first period. The sequence of constant amplitude bytes which are loaded at the beginning of each sample interval are converted to a sequence of noise-like impulses by randomly changing the sign of the amplitude byte using a psuedo-random bit generator, consisting of register 304 and gates 350 and 352 with gate 382, flip-flop 368 and gate 374, the latter elements being used to accomplish the sign change in two's complement form. Initially, and at any time other than during the first period, flip-flop 368 remains reset because of a low signal level developed at the output of gate 382. During the first period, provided that a high signal level is developed at the output of the psuedo-random sequence generator on line 356 and the voice/unvoice signal developed on line 52 is at a high level, the reset of flip-flop 368 is released. Note that the sequence generator is clocked by the first period signal developed on line 26 so that its output will be either high or low during the full interval of the first period. After the signal representing the first non-zero bit has appeared at the shift output of register 302, the next clocking signal developed on line 130 clocks flip-flop 368 causing subsequent excitation bits at the output of gate 390 to be reversed.

When the level of the mode control signal developed on line 54 is high, a signal sample developed on bus 64, is loaded in parallel into register 302, replacing, but serving the same purpose as, the mantisa bits developed on bus 44. Characteristic bits developed on bus 44 are still loaded into counter 300. For operation in the spectral filtering mode, the scale factor code is normally zero, but it may be specified non-zero if it is desired to scale the signal sample.

Figure 7:
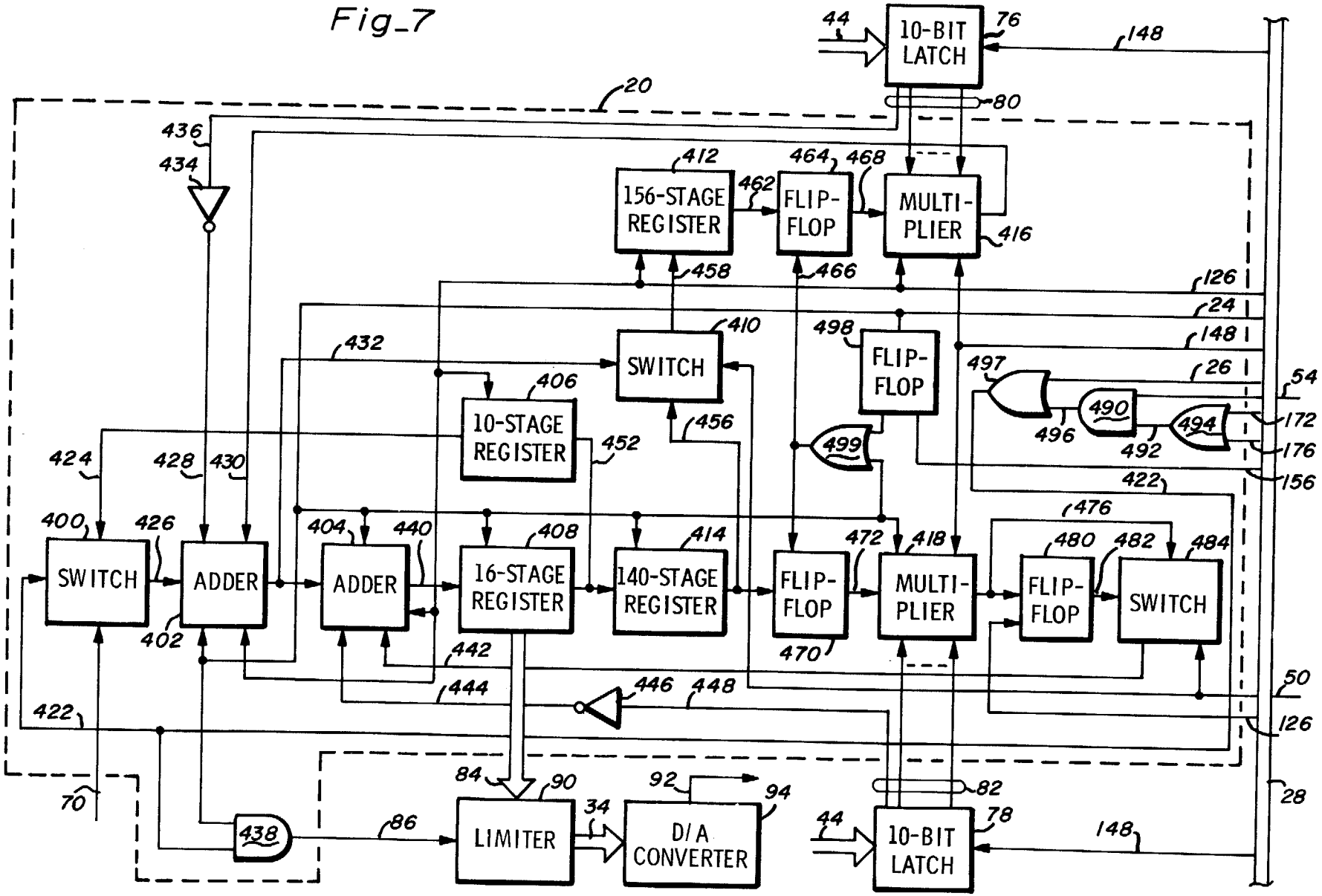
FIG. 7 is a block diagram further illustrating the filter shown in FIG. 1.

In FIG. 7 of the drawing, a more detailed block illustration of filter 20 is depicted. Filter 20 is shown to include as major components a single bit switch 400, a pair of adders 402 and 404, a 10-stage shift register 406, a 16-stage parallel output shift register 408, a single bit switch 410, a 156 stage shift register 412, a 140-stage shift register 414 and a pair of 9-stage multipliers 416 and 418. Switch 400 has a first data input connected to line 70 to receive the excitation signal, a control input connected to a line 422, a second data input connected to a line 424 and a data output connected to adder 402 by a line 426.

Besides an A input connected to switch 400 by line 426, adder 402 has a sign input connected to a line 428, a B input connected to a line 430, a sum output connected to adder 404, a clock input connected to line 126 for receiving the phase-one clocking signal and a clear input connected to line 148 for receiving the first subperiod signal. Line 428 is coupled by an inverter 434 to a line 436 which is the highest order line of bus 80. Line 148 and line 422 each drive a corresponding input of a 2-input AND gate 438 having an output connected to the clocking input of limiter 90 by line 86. Adder 404 has an A input connected to the sum output of adder 402 by line 432, a clear input connected to line 148, a sum output connected to register 408 by a line 440, a clock input connected to line 126, a B input connected to a line 442 and a sign input connected to a line 444. Line 444 is coupled by an inverter 446 to the most significant line of bus 82, a line 448.

Register 406 has a shift input connected to a line 452, a clock input connected to line 126 and a shift output connected to line 424. Register 408 has a shift input connected to line 440, a clock input connected to line 126, a 16th-stage shift output connected to line 452 and 16 parallel outputs connected to corresponding lines of bus 84. Switch 410 has a first data input connected to a line 456, a second data input connected to line 432, a data output connected to a line 458 and a control input connected to line 50.

Register 412 has a shift input connected to line 458, a clock input connected to line 126 and a shift output connected by a line 462 to a data input of a flip-flop 464 having a clock input connected to a line 466 and a non-inverted data output connected to a line 468. Register 414 has a shift input connected to line 452, a clock input connected to line 126 and a shift output connected by a line 456 to a data input of a flip-flop 470 having a clock input connected to line 466 and a non-inverted data output connected to a line 472.

Multiplier 416 has a serial multiplicand input connected to line 468, nine parallel multiplier inputs connected to the respective nine lower order lines of bus 80, a serial product output connected to line 430, a clock input connected to line 126 and a clear input connected to line 24. Multiplier 418 has a serial multiplicand input connected to line 472, nine parallel multiplier inputs connected to the respective nine lower order lines of bus 82, a serial product output connected to a line 476, a clock input connected to line 126 and a clear input connected to line 24.

A flip-flop 480 has a data input connected to line 476, a clock input connected to line 126 and a non-inverted output connected by a line 482 to a first data input of a switch 484. Additionally, switch 484 has a second data input connected to line 476, a control input connected to line 50 and a data output connected to line 442.

An AND gate 490 has an input connected to line 54 to receive the mode signal and another input connected by a line 492 to the output of a OR gate 494 having a first input connected to line 172 to receive the third-period signal and a second input connected to line 176 to receive the fifth-period signal. The output of gate 490 is connected by a line 496 to an input of an OR gate 497 having another input connected to line 26 to receive the first-period signal and an output connected to line 422. A flip-flop 498 has a set input connected to line 148, a reset input connected to line 158 and a data output connected to one input of an AND gate 499 having another input connected to line 126 and output connected to line 466.

In order to explain the operation of filter 20, additional reference is made to FIG. 8A, 8B and 8C of the drawing. FIG. 8A illustrates a second-order digital filter section 500, in block form. FIG. 8B illustrates a cascaded pair of first-order digital filter sections 502, in block form. FIG. 8C illustrates a Z-plane representation 504 of the filter sections shown in FIG. 8A and 8B.

Filter section 500 includes an adder 510, a pair of multipliers 512 and 514 and a pair of time delay elements 516 and 518. Each of the time delay elements provides a delay equal to the 100 microsecond sample interval. The delayed filtered samples in elements 516 and 518 are scaled by coefficients B1 and B2 coupled to multipliers 512 and 514 and summed with the input sample by adder 510. Assuming that the above-mentioned operation takes place during an interval T0, then at the beginning of the next interval, T1, delay element 516 contains the filtered input sample, and delay element 518 contains the filtered sample that was in delay element 516 at the beginning of T0. It is clear that this operation can be carried out serially using serial arithmetic elements, such as shift registers, for delay elements 516 and 518. It is also clear that the output sample may be obtained from delay element 516 rather than from delay element 518, since the contents of delay element 518 is the same as that of delay element 516 one sample interval earlier. It is necessary, however, to include both delay elements to perform second-order filtering.

With additional reference to FIG. 7, corresponding to time-delay element 516 of FIG. 8 is the 156-bit shift register comprised of the combination of the 16-bit register, register 408, and the 140-bit register, register 414. The 156-bit register 412 corresponds to time delay element 518. By employing a 1.56 megahertz system clocking signal, developed on line 126, to continuously drive both sets of delay registers and both of the serial multipliers, multiplier 416 and multiplier 418, the data samples within the registers are completely cycled in each 100 microsecond interval. In the place of adder 510 of FIG. 8 are two, 2-input adders, adder 402 and 404 of FIG. 7, the substitution facilitating the processing of real-axis transfer functions by the filter. During each of the first periods, the signal developed on line 422 toggles switch 400 so as to allow the excitation signal developed on line 70 to drive the filter. During the other periods, period two through period six, switch 400 couples the filter sample, delayed by register 408 and register 406, into the input of the filter, in effect cascading the second-order sections by allowing the output sample from one filter section to enter the input of the next filter section.

At the end of the complete sample interval, the register consisting of register 408 and register 414 contains the first-delayed filtered sample. At the end of the next interval the same sample is contained in register 412 having passed from the output of register 414 through switch 410 to register 412, as the second-delay filtered sample.

During each of the periods, period one through period six, appropriate filter coefficients are stored in latches 76 and 78, signals representing the filter coefficients being clocked into the latches during the first subperiod of each of the periods. Those signals which represent the nine least significant bits developed at the outputs of latches 76 and 78 are coupled into the parallel inputs of multipliers 416 and 418. The multipliers receive serial input signals from flip-flops 464 and 470, which are driven by the serial data streams from registers 412 and 414, respectively. The signal developed on line 476 at the output of multiplier 418, which represents the scaled first-delayed filtered sample, is normally coupled to the B input of adder 404 by flip-flop 408 through switch 484 providing a single time delay. Simultaneously, the scaled second-delayed filtered sample signal developed by multiplier 416 is coupled to the B the input of adder 402.

In order to simplify the design of the multipliers, the parallel multiplier input signals developed on buses 80 and 82 represent unsigned magnitudes. Therefore, the coefficients B1 and B2 are in signed magnitude form (rather than two's complement form) and the signals which represent the sign bits are coupled to the adders rather than to the multipliers. The signed bit signal from latch 76 is coupled by inverter 434 to the sign input of adder 402. Similarly the sign bit signal from latch 78 is coupled by inverter 446 to the sign input of adder 404. The sign bit signals are inverted because the second-order filter function requires that the delayed scaled filtered samples be algebraically subtracted from the input sample.

It should be noted that the serial multiplication process produces an output product whose length is equal to the sum of the lengths of the multiplier and the multiplicand. In this case, with a 16-bit intermediate data sample and a 10-bit coefficient multiplier (it being implied that the 9-bit magnitude of the multiplier is preceded by a zero sign bit), a 26-bit product is generated. The products appear least significant bit first, with a 26-bit data stream being in effect, truncated to a 16-bit significant higher portion. Such truncation occurs because the output sample signals of each of the second-order filter sections developed at the output of delay register 408, are delayed an additional ten bits by delay register 406 before being coupled to the input of the filter section by line 424 and switch 400. Also, at each of the multipliers, the sign of the multiplicand is extended after the first 16 bits have entered the multiplier. More particularly, starting at the first subperiod for each of the periods, period one through period six, the signal developed on line 456 by register 414 is clocked through flip-flop 470 until flip-flop 498 is reset during the fifth subperiod. Thereafter, the output of flip-flop 470 remains in the state of the most significant sign bit of the multiplicand until flip-flop 498 is set on the next first subperiod. The sign of each multiplicand is extended over the first ten or "don't car bits" of the next 26-bit multiplicand. Similar sign extension is accomplished by flip-flop 464 for multiplier 416.

With reference again to FIG. 8A, it will be noted that the first filter coefficient of each second-order pair is equal to minus two times the abscissa of its pole location. Rather than express the doubling in the stored coefficient values, it is convenient to incorporate the doubling in the filter by providing an extra one bit delay, provided by flip-flop 480, for the first-delayed filtered samples.

At the beginning of the first period, when the excitation signal developed on line 70 drives the filter, a filtered output sample portion of the first-delayed filtered sample formed during the previous sample interval is present in delay register 408, the remainder being in register 414. The taps of register 408 permit the output sample to be transferred in parallel fashion to limiter 90 for analog conversion, or in spectral filtering, to be placed on the output bus. Correct scaling by the source generator places the 8-bit output field in the center of the 16-bit sample field. Thus, when transferred to limiter 90 during the first subperiod of the first period, four more significant bits are transferred for use in overflow checking.

It may be noted that the choice of a 16-bit intermediate sample length (often called "data in process") and placement of the 8-bit output field in the center of a sample field is based on a number of considerations. First, for a given coefficient magnitude, filter performance is improved as the intermediate sample length (accuracy) is increased. A size of 16 bits has been found to be adequate for good quality synthesized speech while maintaining practical data rates for MOS processes. Also, the magnitude of the intermediate sample will in most cases exceed the magnitude of the filtered output sample. Thus, it being desirable to maintain the largest magnitude of intermediate sample consistent with the field available for the intermediate sample, it has been found that an 8-bit output field placed at the center of the 16-bit data field overflows only infrequently in typical speech productions.

In linear prediction analysis of speech, it is often found that after the polynomial is reduced to second order factors, that one, but seldom more than one, of the factors has real solutions. As shown in FIG. 8B, using a pair of delays 430 and 432, a pair of real-axis poles can be realized by two first-order filter sections using substantially the same circuit elements as a single second-order section. Returning to FIG. 7, a real-axis control signal developed on line 50 drives switch 410 and 484. During the sixth period when the real-axis control signal is active, the signal developed at the output of adder 402 on line 432 is switched to line 458 to drive the second-delayed filtered sample register, register 412, register 412 normally being driven by signals on line 456. In this fashion, the filtered sampled signal developed in the fifth period at the output of register 406 is coupled through switch 400, adder 402 and switch 410 to register 412 for processing by multiplier 416. Additionally, the sample signal developed at the output of multiplier 416 is coupled to adder 404 for processing by multiplier 418 to form a first-order filtered sample in register 408.

In the configuration of the filter in which the real-axis control signal is active, register 412 corresponds to delay element 530 in FIG. 8, and registers 408 and 414 of FIG. 7 correspond to delay elements 532 of FIG. 8. An active real-axis control signal causes switch 484 to bypass the one bit delay provided by flip-flop 480, the first-order coefficient not being doubled.

An active state of the mode control signal developed at the input of gate 490 on line 54 changes the configuration of the time multiplexed digital filter. In the preferred embodiment, a source sample developed on line 70 is subjected to three different fourth-order filters. The first signal, which drives the filter during the beginning of the first period is filtered and clocked into limiter 90 at the beginning of the third period, the signal received during the third period being clocked into the limiter during the fifth period and the signal received during the fifth period being clocked into the limiter during the first period. This configuration may be used to provide three different band-pass operations on a sequence of wave-form signals. In alternative embodiments, gates 490, 494 and 497 are wired differently creating, in one case, one fourth-order section with one eighth-order section.

It should be noted that, for clarity, a time delay of 156 clock cycles, represented by register 412 and the combination of registers 408 and 414, was specified. In practice, the length of the registers is shortened slightly to compensate for other circuit delays such as single-bit delays occurring in the multipliers, the adders and the sign extenders. Furthermore, to achieve minimum size in circuit integration, the shift registers used to implement the delays are inactive during the intervals of the sign extensions from the fifth subperiod to the end of the respective period, these being the same intervals during which "don't care bits" enter the registers. By gating the phase-one clock developed on line 126 only during the first through the fifth subperiods, delay register 414 is shortened to 80 bits, delay register 412 to 96 bits, and delay register 406 eliminated.

In FIG. 8C it may be seen that a second-order filter section, such as section 500, of FIG. 8A, has a pair of complex poles illustrated at 540 while a cascaded pair of first order sections, such as pair 500, of FIG. 8B, has a pair of real poles 542. A stable transfer function requires Z-plane poles lie within a circle 544 of unit radius.

It is well known that coefficient B1 for the second-order digital filter is equal to minus two times a real part, X, of the complex pole locations, while coefficient B2 is equal to the square of the radius vector, R, to either pole. Also, for low frequency or high frequency poles close to the unit circle (poles near plus one, zero or near minus one, zero), that a small change in B1, while keeping B2 constant, is equivalent to a relatively large shift in pole frequency, causing the poles to move along an arc concentric with the unit circle. Conversely, near these critical locations, a small decrease in B2 may result in a specification that does not correspond to any valid transformation from the Z-plane, one which may cause filter instability.

Further, filter performance for higher order functions is dominated by poles lying close to the unit circle which have large values of B2. For these poles, small changes in B2 markedly effect the filter output, while for poles further from the unit circle, relatively large changes in B2 have a relatively small effect.

A table of filter coefficients suitable for use in ROM 18 is shown in FIG. 9. The arrangement of the coefficients significantly reduces the above-mentioned effects. It will be noted that large coefficients at the top of the table descend in small steps while small coefficients at the bottom of the table descend in large steps. The preferred embodiment of ROM 18 contains 128 nine-bit coefficients (magnitude only) a number suitable for synthetic speech of good quality. When addressing such a ROM with 7-bit codes, the upper ten percent of the address range cover only a three to four percent range of coefficient values, while the lowest ten percent of address range cover a twenty to twenty-five percent coefficient range. From a set of 128 coefficients it is possible to select only 128 different values for B1 or B2. However, when these values are large, representing poles close to the unit circle, the coefficients maintain 9-bit accuracy with respect to distances from the unit circle, behaving as if they had been selected from a table of 512 different values.

Figure 10:
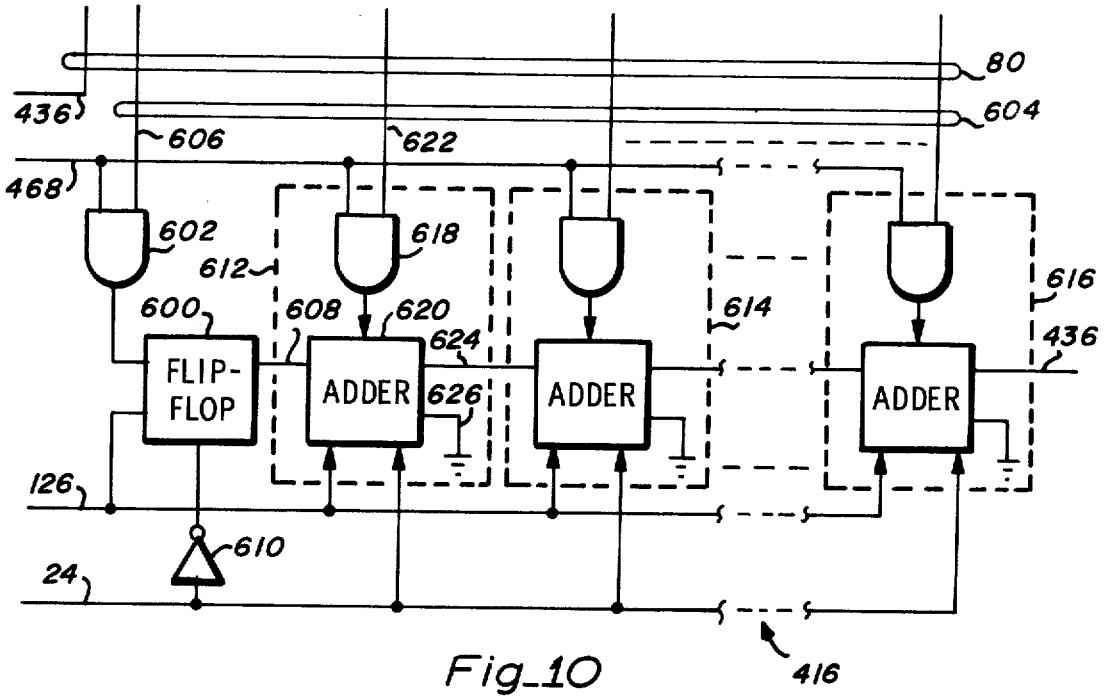
FIG. 10 is a block diagram further illustrating the multiplier shown in FIG. 7.

It should be noted that poles in the mid-frequency range, around 2,500 hertz, have small values of B1 and that, in some cases, frequency cannot be specified with an accuracy better than 25 to 50 hertz. In practice, this has been found to have little effect on the quality of synthesized speech. When the synthesizer is used as a spectral filter, and particularly in tone discrimination, mid-range frequency inaccuracies may be significant. Often times, in such cases, it is possible to modify B2 or to slightly change the filter sampling rate to achieve correct discrimination. FIG. 10 of the drawing further illustrates multiplier 416, which is similar to multiplier 418. Multiplier 416 is comprised of a flip-flop 600 having a clock input connected to line 126 for receiving the phase-one clocking signal and a data input connected to the output of a 2-input AND gate 602. Gate 602 has an input connected to line 468 for receiving, in serial form, the signal representing the multiplicand and another input connected to a line 606, which is the most significant line of a nine line bus 604 comprised of the nine least-significant lines of the ten lines comprising bus 80, the input for receiving in parallel form bit signals of the multiplier. Additionally, flip-flop 600 has a non-inverted data output connected to a line 608 and a reset input coupled by an inverter 610 to line 24 for receiving the power-on-reset signal developed thereon.

Multiplier 416 is further comprised of eight multiplier stages, including a stage 612 and seven stages 614–616. Stage 612, which is similar to stages 614–616, includes a 2-input AND gate 618 and a full adder 620. Gate 618 has an input connected to line 468, another input connected to a line 622, line 622 being the second-most significant line of bus 604 and an output. Adder 620 has a B input connected to line 608, an A input connected to the output of gate 618 by a line 623, a sum output connected to a line 624, a sign input connected to circuit ground by a line 626, a clear input connected to line 24 for receiving the power-on-reset signal developed thereon and a clock input connected to line 126 for receiving the phase-one clocking signal.

Multiplier 416 employs the signal developed in serial bit form on line 468 as a multiplicand and the nine lower-order bits of the coefficient signal developed in parallel on bus 80 as a multiplier to develop a serial bit stream signal on line 436 representing the product thereof. More particularly, each stage of multiplier 416, develops a signal representing a partial product bit from a signal representing a previous partial product bit developed by the preceeding multiplier stage during the preceeding cycle of the clocking signal developed on line 126. Gated by the signal developed on the respective line of bus 604, as by gate 618 of stage 612, each of the bits represented by the signal developed on line 468 during a particular clock cycle is added, in adder 620, to a corresponding previous partial product bit obtained from the signal developed by the previous stage, on line 608, to develop, on line 624, the partial bit signal. Since the first multiplier stage lacks a previous partial product bit, the bit represented by the signal developed on line 468 is gated in gate 602 by the signal developed on line 606 and delayed one clock cycle in flip-flop 600 to develop a partial product bit signal on line 608.

By employing a two's complement representation for the multiplicand and an unsigned number for the multiplier, the product always has the same sign as the multiplicand, permitting a degree of circuit simplification.

Figure 11:
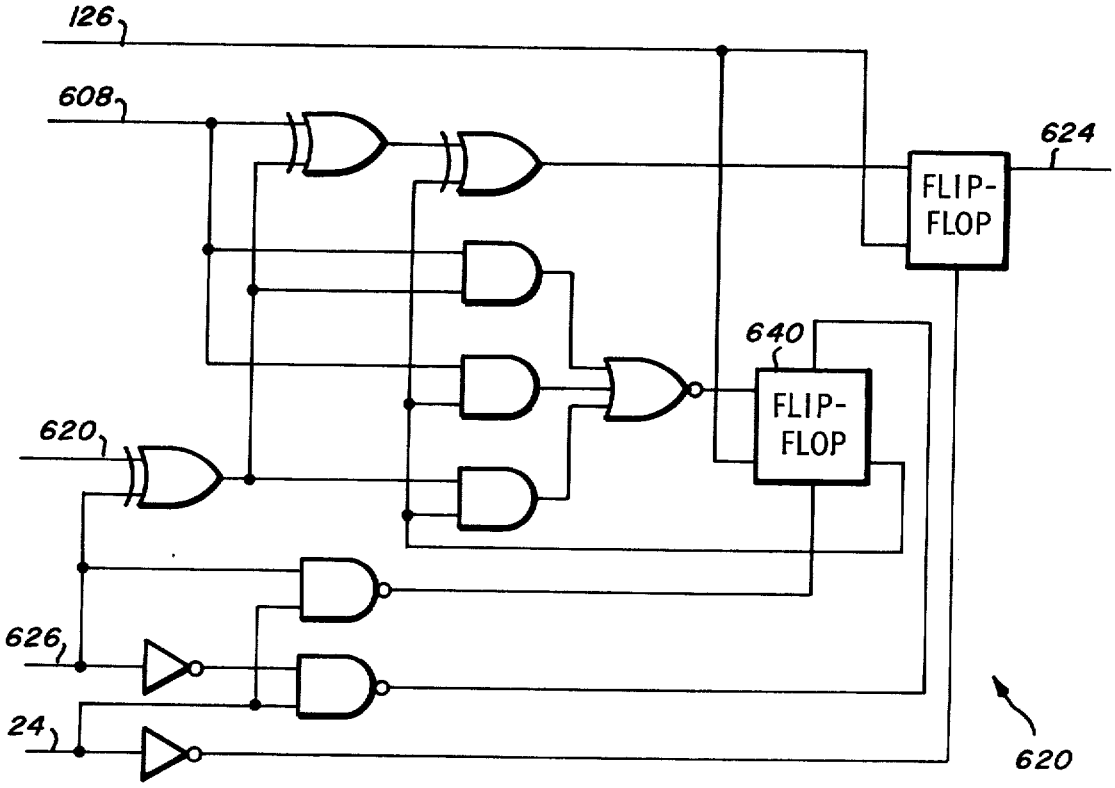
FIG. 11 is a block diagram further illustrating the adder shown in FIG. 10.

Illustrated in FIG. 11 of the drawing is adder 620, which is also representative of adders 402 and 404 of FIG. 7 and those in multiplier stages 614–616. Adder 620 is of conventional design developing a signal on line 624 representing the sum or difference of the bits represented by signals developed on lines 608 and 620, the sum or difference being delayed one cycle of the clock signal developed on line 126. The signal developed on line 626 selects the function, addition or subtraction. A flip-flop 640 maintains a carry bit, for addition, or a borrow bit, for subtraction, for use during the following clock cycle. The signal developed on line 24 clears the carry, or sets the borrow bit, as determined by the signal developed on line 626.

Figure 12:
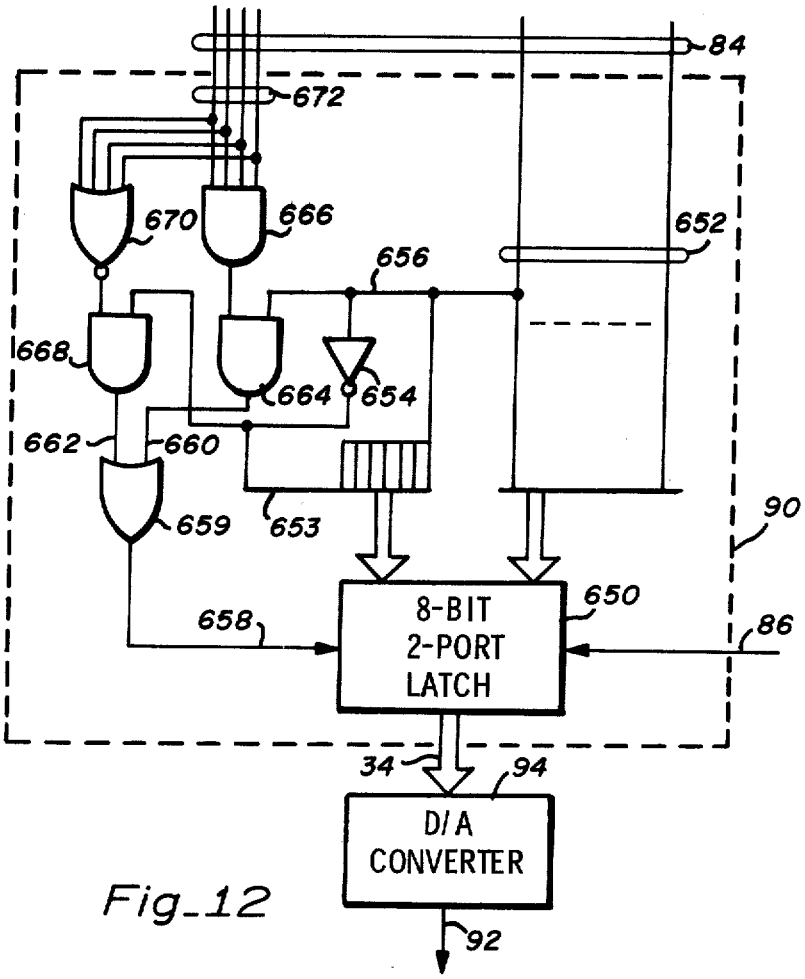
FIG. 12 is a block diagram further illustrating the limiter shown in FIG. 1.

In FIG. 12 of the drawing, limiter 90 is shown to comprise an 8-bit 2-port latch 650. Latch 650 includes a first data input port having eight lines connected, by a bus 652, to the corresponding ones of the fifth through the twelfth most significant lines of bus 84 and a second data input port having eight lines the most significant one of which is coupled by a line 653, an inverter 654 and a line 656 to the most significant line of bus 652. The other seven lines are directly connected to line 656. Additionally, latch 650 includes a clock input connected to line 86, an output port having eight lines connected to the respective lines of bus 34 and a select input connected to a line 658.

Additionally, line 658 is connected to the output of an OR gate 659 having an input connected to a line 660 and another input connected to a line 662. Line 660 is connected to the output of an AND gate 664 having an input connected to line 656 and another input connected to the output of an AND gate 666. Line 662 is connected to the output of an AND gate 668 having an input connected by line 653 to the output of inverter 654 and another input connected to the output of a NOR gate 670. Gate 666 has four inputs connected to the respective four lines comprising a bus 672 which is connected to the four most significant lines of bus 84. Gate 670 also has four inputs connected to the respective four lines of bus 672.

Since, for two's complement coding, the bit represented by the signal developed on line 656 is high for a negative number, overflow has not occurred if all of the higher order bits represented by the signals developed on bus 672 are also high. In this case, gate 664 generates a high logic level signal on line 660 causing latch 650 to latch the signals developed on bus 652. When the bit represented by the signal developed on line 656 is low, and one or more of the higher order bits is high, a negative number has overflowed. When this occurs, the largest eight bit negative number developed from the signals generated on lines 653 and 656 is latched by latch 650. Conversely, when the bit represented by the signal developed on line 656 is high, and one or more of the higher order bits is low, a positive number has overflowed. In this case, the largest eight bit positive number is latched into latch 650.

It should be noted that all of the circuit elements comprising speech synthesizer 10 are standard logic elements of the type which may be constructed of transistors commonly fabricated in various metal-oxide-silicon (MOS) processes, such as CMOS noted for low power consumption and useful in such applications as watches and hand held instruments, PMOS noted for low processing cost, and NMOS noted for small size and high operating speed.

Although it is contemplated that after having read the preceeding disclosure, certain alterations and modifications of the present invention will no doubt become apparent to those skilled in the art, it is intended that the following claims be interpreted to cover all such alterations and modifications as fall within the true spirit and scope of the invention.

What is claimed is:

1. A speech synthesizer for developing a signal representing voiced and fricative sounds from signals representing blocks of sound describing data, the synthesizer comprising in combination:

a timing generator including means for generating a signal delineating a series of predetermined sample intervals and means for generating a signal delineating a plurality of major periods within each of said sample intervals including a first period;

double buffering means connected to said timing generator, said double buffering means including first data block storing means for asynchronously receiving the signals representing members of a block of the data, second data block storing means for developing signals representing a previously received one of said blocks of said data and means for updating said second data block storing means from said first data block storing means;

period counting means connected to said timing generator and said double buffering means, said period counting means for developing a signal delineating a series of pitch periods each having a duration specified by said previous data signals;

source generating means connected to said timing generator and said period counting means and coupled to said double buffering means, said source generating means for periodically developing an excitation signal having an amplitude specified by said previous data signals, said source generating means including means for varying the sign of said excitation signal in a quasi-random fashion, said excitation signal being developed once during each of said pitch periods for voiced signals, said excitation signal being developed once during each of said first periods with said quasi-randomly varying sign for fricative sounds;

filter coefficient generating means connected to said timing generator and said double buffering means, said filter coefficient generating means for generating signals representing filter coefficients from said previous data signals;

a time multiplexed digital filter connected to said timing generator, said source generating means and said filter coefficient generating means, said filter being configurable as a two-pole filter and as a pair of cascaded single pole filters responsive to said previous data signals, said filter having filter characteristics defined by said filter coefficient signals, said filter including an output and an input connected to said source generating means during each of said first periods for receiving said excitation signal and being connected to said filter output otherwise; and output means coupled to said filter output during each of said first periods said output coupling means for developing the sound signal.

2. A speech synethesizer as recited in claim 1 wherein said filter coefficient generating means includes a ROM for storing a plurality of predetermined filter coefficients, said ROM being responsive to said previous data signals as addresses and operative to retrieve addressed filter coefficients and to develop said filter coefficient signals.

3. A speech synthesizer as recited in claim 1 further including repeat signal generating means connected to said double buffering means and said period counting means, said repeat signal generating means for developing a repeat signal delineating a number of said pitch periods specified by said previous data signals and wherein said double buffering means is responsive to said repeat signal and operative to update said second data block storing means.

4. A speech synthesizer as recited in claim 3 wherein said filter coefficient generating means includes a ROM storing a plurality of predetermined filter coefficients, said ROM being responsive to said previous data signals as addresses and operative to retrieve addressed filter coefficients and to develop said filter coefficient signals.

5. A speech synthesizer as recited in claim 4 wherein said output means includes coupling means and a D/A converter coupled to said filter by said coupling means, whereby said D/A converter develops said sound signal.

6. A speech synthesizer as recited in claim 5 wherein said coupling means includes a limiter connected to said filter output during each of said first periods to develop a filtered signal comprised of at least a predetermined plurality of bit signals having a reference bit signal, a predetermined plurality of bit signals more significant than said reference bit signal and a plurality of bit signals less significant than said more significant bit signals, said limiter including an overflow detecting means for developing a signal which indicates lack of overflow when the state of each of said more significant bit signals and said reference bit signal are all similar and latch means for receiving said overflow signal and for developing a D/A converter driving signal comprised of said less significant bit signals in the absence of overflow and otherwise for developing said D/A converter driving signal such that all but a most significant bit signal thereof have a state corresponding to that of said reference bit signal, said most significant bit signal of said D/A converter driving signal having a state opposite that of said reference bit signal.

7. A speech synthesizer as recited in claim 4 wherein said plurality of filter coefficients stored in said ROM define pole locations in Z-plane representation and wherein a disproportionate number of said plurality of filter coefficients define poles which lie in relative proximity to the Z-plane unit circle.

8. A speech synthesizer as recited in claim 4 wherein said amplitude of said excitation signal is specified by said previous data signals in scientific notation including a characteristic portion and a mantisa portion.

9. A speech synthesizer as recited in claim 8 wherein said timing generator further includes means for generating a clocking signal at a predetermined rate and wherein said source generator includes:

means for developing a preload signal during each of said ptich periods for voiced signals and for developing said preload signal during each of said first periods for fricative sounds;

a counter having preload inputs connected to said double buffering means for receiving said characteristic portion of said previous data signals, a preload input connected to said preload means for receiving said preload signal, a clock input connected to said clocking means for receiving said clocking signal and a carry output, said counter for developing a carry-out signal following the occurrence of said preload signal after a number of cycles of said clocking signal which is proportional to said characteristic portion of said previous data signals;

a shift register having preload inputs connected to said double buffering means for receiving said mantisa portion of said previous data signals, a preload input connected to said preload means for receiving said preload signal, a clock input and a shift output;

gating means connected to said carry output for receiving said carry-out signal and connected to said clocking means for receiving said clocking signal, said gating means for coupling said clocking signal to said shift register following the occurrence of said carry-out signal; and means connected to said shift output for developing said excitation signal.

10. A speech synthesizer as recited in claim 4 wherein said timing generator further includes means for generating a clocking signal at a predetermined rate and wherein said filter includes:

first shift register means having a shift input, a shift output, parallel outputs for connection to said output means and a clock input for receiving said clocking signal;

second shift register means having a shift input connected to said shift output of said first shift register means, a shift output and a clock input for receiving said clocking signal;

first multiplier means having a multiplicand input coupled to said shift output of said second shift register, a multiplier input for receiving said filter coefficient signals, a product output and a clock input for receiving said clocking signal;

third shift register means having a shift input connected to said shift output of said second shift register, a shift output and a clock input for receiving the clocking signals;

second multiplier means having a multiplicand input coupled to said shift output of said third shift register, a multiplier input for receiving said filter coefficient signals, a product output and a clock input for receiving said clocking signal;

adder means having a first sum input, a second sum input coupled to said product output of said first multiplier means, a third sum input connected to said product output of said second multiplier means and a sum output connected to said serial input of said first shift register; and switch means having a first input connected to said source generating means, a second input coupled to said shift output of said first shift register means, a switch output connected to said first sum input and a control input for receiving a signal derived from said major period delineating signal.

* * * * *